US010024561B2

(12) United States Patent
Olson

(10) Patent No.: US 10,024,561 B2
(45) Date of Patent: Jul. 17, 2018

(54) WASHING APPLIANCE WITH IMPROVED AIR HANDLING SYSTEM

(71) Applicant: ILLINOIS TOOL WORKS INC., Glenview, IL (US)

(72) Inventor: Jonathan H. Olson, Sussex, WI (US)

(73) Assignee: Illinois Tool Works Inc., Glenview, IL (US)

( * ) Notice: Subject to any disclaimer, the term of this patent is extended or adjusted under 35 U.S.C. 154(b) by 703 days.

(21) Appl. No.: 14/370,503

(22) PCT Filed: Jan. 11, 2013

(86) PCT No.: PCT/US2013/021107
§ 371 (c)(1),
(2) Date: Jul. 3, 2014

(87) PCT Pub. No.: WO2013/106624
PCT Pub. Date: Jul. 18, 2013

(65) Prior Publication Data

US 2014/0360534 A1 Dec. 11, 2014

Related U.S. Application Data

(60) Provisional application No. 61/586,134, filed on Jan. 13, 2012.

(51) Int. Cl.

| | |
|---|---|
| ***F24F 7/007*** | (2006.01) |
| ***A47L 15/48*** | (2006.01) |
| *D06F 39/12* | (2006.01) |
| *D06F 35/00* | (2006.01) |

(52) U.S. Cl.
CPC ..... *F24F 7/007* (2013.01); *A47L 15/486* (2013.01); *A47L 15/488* (2013.01); *D06F 35/008* (2013.01); *D06F 39/12* (2013.01)

(58) Field of Classification Search
CPC ..... A47L 15/486; A47L 15/488; F24F 7/007; D06F 39/12; D06F 35/008
See application file for complete search history.

(56) References Cited

U.S. PATENT DOCUMENTS 3,092,122 A * 6/1963 Guth ..... A47L 15/0034 134/108
3,876,469 A * 4/1975 Schimke ..... A47L 15/488 134/95.2

(Continued)

FOREIGN PATENT DOCUMENTS

CN 1245673 A 3/2000
CN 201027259 Y 2/2008

(Continued)

OTHER PUBLICATIONS

ISR and WO for PCT/US2013/021107 dated Apr. 25, 2013.

*Primary Examiner* — Michael Barr
*Assistant Examiner* — Benjamin L Osterhout
(74) *Attorney, Agent, or Firm* — Boyle Fredrickson, S.C.

(57) ABSTRACT

A humidity reducing vent for a washing appliance such as a dishwasher or washing machine employs a jet pumping action allowing a single electric blower to move and mix humid air exhausted from the washing appliance washing chamber and external dry air streams together prior to discharge so as to reduce condensation outside of the washing appliance.

15 Claims, 7 Drawing Sheets

(56) References Cited

U.S. PATENT DOCUMENTS

| | | | | |
|---|---|---|---|---|
| 4,188,732 | A * | 2/1980 | Quayle | A47L 15/488 134/95.3 |
| 4,195,419 | A * | 4/1980 | Quayle | A47L 15/488 134/102.3 |
| 4,247,158 | A * | 1/1981 | Quayle | A47L 15/488 134/200 |
| 6,170,166 | B1 | 1/2001 | Johansen et al. | |
| 6,578,591 | B1 * | 6/2003 | Eksert | A47L 15/486 134/107 |
| 7,887,643 | B2 | 2/2011 | Stelzer et al. | |
| 7,909,939 | B2 | 3/2011 | Brewer et al. | |
| 2004/0226623 | A1 * | 11/2004 | Chenoweth | B29C 47/0023 138/121 |
| 2008/0005926 | A1 * | 1/2008 | Goggin | D06F 58/20 34/605 |
| 2008/0190467 | A1 * | 8/2008 | Maunsell | A47L 15/0084 134/58 DL |
| 2008/0202566 | A1 | 8/2008 | Gonska et al. | |
| 2008/0264455 | A1 * | 10/2008 | Brewer | A47L 15/483 134/95.2 |

FOREIGN PATENT DOCUMENTS

| | | | |
|---|---|---|---|
| CN | 101193582 | A | 6/2008 |
| CN | 201798715 | U | 4/2011 |
| DE | 19704430 | A1 | 8/1998 |
| EP | 0920830 | A1 | 6/1999 |
| EP | 1961363 | A2 | 8/2008 |
| WO | 9963880 | A1 | 12/1999 |

* cited by examiner

WASHING APPLIANCE WITH IMPROVED AIR HANDLING SYSTEM

CROSS REFERENCE TO RELATED APPLICATION

This application is a National Phase of International Application Number PCT/US2013/021107 filed Jan. 11, 2013, and claims the benefit of US provisional application 61/586,134 filed Jan. 13, 2012 and hereby incorporated in its entirety by reference.

FIELD OF THE INVENTION

The present invention relates to washing appliances such as dishwashers and clothes washing machines which provide a sealable chamber for washing, and in particular to an air handling system for reducing humidity in such appliance chambers.

BACKGROUND OF THE INVENTION

Dishwashers, such as those found in many homes, provide a washing chamber holding one or more racks sized to support eating utensils and cookware for cleaning. The washing chamber may be sealed by a door opening at the front of the washing chamber to allow loading and unloading of the chamber. The door is closed during a washing cycle to prevent the escape of water sprayed within the volume of the washing chamber during the washing of items placed in the racks. Upon completion of the washing cycle, a drying cycle is initiated during which water is drained from the washing chamber and moist air is discharged through a vent. Cool air, pulled by convection or by a fan into the chamber through a lower vent, flows upward, augmented by natural convection to dry the heated dishes.

Recent dishwasher designs may employ a one-piece tub, for example of stainless steel, which defines the washing chamber and, when closed by the door, is sealed from communication with the outside air. The sealed nature of this chamber makes the promotion of air circulation for proper venting particularly difficult.

U.S. Pat. No. 7,887,643 entitled: "Dishwasher With Counter-Convection Air Flow", assigned to the same assignee as the present invention and hereby fully incorporated by reference, describes a downdraft venting system in which low-turbulence down-flow is created within the washing chamber to more efficiently remove moisture-laden air from the washing chamber and dishes. In one embodiment, a relatively small fan placed at the top of the washing chamber draws dry air into the washing chamber to push moist air out of existing vents near the bottom of the washing machine door.

The greater efficiency of this downdraft design in removing moisture from the washing chamber and contained dishes can create condensation problems when high humidity air is exhausted from the dishwasher and contacts cool surfaces, such as a metal-faced dishwasher door. This condensation may cause the undesirable collection of water on surfaces near the vent outlet.

U.S. Pat. No. 7,909,939, entitled: "Humidity Reducing Exhaust Duct for Dishwasher", assigned to the same assignee as the present invention and hereby fully incorporated by reference, describes an exhaust duct designed to handle the higher humidity air provided by more efficient low turbulence down-flow venting or the like. The duct provides a mixing chamber to mix cool dry air with the warm humid air and a reservoir for accumulating condensation before exit from the duct into the environment around the dishwasher. This reservoir may be dried by continued fan operation after the venting is complete.

Clothes washing machines, and in particular water-saving, front-loading washing machines, may provide a sealed door preventing the escape of water during the washing cycle. If this door is closed after completion of the washing cycle and removal of the washed clothes, residual humidity can be trapped in the washing chamber, risking the growth of mold or the generation of musty odors.

SUMMARY OF THE INVENTION

The present invention provides an improved mixing chamber for a humidity reducing duct system for dishwashers, washing machines, or other similar appliances. The mixing chamber employs a jet pump allowing a single fan to promote the mixing of moist air from the washing chamber with dry outside air. In one embodiment, an electric blower provides high velocity jet into the mixing chamber which draws moist air from the washing chamber as displaced by dry air diverted from the same electric blower.

Specifically, the present invention provides a vent system for a washing appliance having a mixing chamber providing a first and second inlet spaced from an outlet of the mixing chamber, the first and second inlet configured to provide a jet pump action where a first airstream through the first inlet draws a second airstream through the second inlet to mix therewith and be discharged through the outlet. First ducting communicates between the mixing chamber and a washing chamber of a washing appliance so that one of the first and second inlets receives moist air through the ducting from the mixing chamber, and the other of the first and second inlets receives relatively drier air from outside of the washing chamber of the washing appliance. An electric blower communicates with the mixing chamber to produce a pressure difference generating the first airstream.

It is thus a feature of at least one embodiment of the invention to provide for a powered venting of a washing appliance washing chamber in which a single fan can provide for the movement and intermixing of both dry and moist airstreams.

The ducting may attach to the second inlet and the electric blower may be positioned at the first inlet to intake the drier air from outside the air washing chamber and discharge it through the first inlet.

It is thus a feature of at least one embodiment of the invention to provide design that allows the electric blower to be isolated from moist air.

The electric blower may communicate with the first inlet through a bifurcated passageway having a first branch attached to the first inlet and a second branch communicating with second ducting communicating between the second branch and the washing chamber of the washing appliance.

It is thus a feature of at least one embodiment of the invention to provide a positive displacement of moist air from the washing appliance with a single fan that moderates pressure build up within the washing chamber by balancing airflows and pressures into and out of the washing chamber.

The first ducting may communicate with the washing chamber at a position substantially below all racks holding items for washing in the washing chamber and the second ducting may communicate with the washing chamber at a position substantially above all racks holding items for washing in the washing chamber to provide for a counter-convection airflow.

It is thus a feature of at least one embodiment of the present invention to provide superior moisture extraction from the washing appliance washing chamber as obtained by counter-convection nonturbulent airflow.

The mixing chamber may include a condensation reservoir for collecting water condensing out of the moist air.

It is thus a feature of at least one embodiment of the invention to extract and retain excess moisture in the vented air to prevent condensation outside of the washing appliance and vent system.

The electric blower may be displaced upward on the mixing chamber with respect to the condensation reservoir.

It is thus a feature of at least one embodiment of the invention to provide a condensation system that shields the electric motor and fan from moisture.

The mixing chamber may provide for a substantially horizontal airflow.

It is thus a feature of at least one embodiment of the invention to provide a system that promotes a directing airflow away from the washing appliance adaptable to a shallow extended horizontal moisture collection reservoir.

The outlet of the mixing chamber may be preceded by a passageway directing airflow out of the outlet at an upward angle from horizontal during operation of the mixing chamber.

It is thus a feature of at least one embodiment of the invention to provide a venting system that may fit beneath the washing appliance to discharge moist air therefrom while reducing condensation on the floor.

The vent system may use only a single fan communicating with the mixing chamber.

It is thus a feature of at least one embodiment of the invention to provide for a low cost but effective venting system that reduces exhausted moisture.

The electric blower may include a brushless DC motor and a centrifugal fan.

It is thus a feature of at least one embodiment of the invention to permit the use of energy-efficient low noise fans.

The ducting may be polymer tubing presenting inwardly extending circumferential ridges over an axial length of at least 12 inches. The polymer tubing may have an average internal diameter of between 0.6 and two inches.

It is thus a feature of at least one embodiment of the invention to provide for noise reduction with respect to noise escaping from the washing appliance during washing operations without the need for mechanically actuated doors over the vent openings. The inward ridges on the ducting provide an acoustic muffler without undue airflow resistance.

The inwardly extending ridges may be in the form of circumferential pleats in an outer wall of the tubing.

It is thus a feature of at least one embodiment of the invention to provide ducts that provide both acoustic muffling and improved flexibility.

The tubing may be formed to provide at least one upwardly extending loop in the tubing between the chamber outlet and the exhaust port.

It is thus a feature of at least one embodiment of the invention be able to position the vent connections to the washing appliance without concern for escaping water which is returned by the trapping action of the loops.

Other features and advantages of the invention will become apparent to those skilled in the art upon review of the following detailed description, claims and drawings in which like numerals are used to designate like features.

Figure 1:
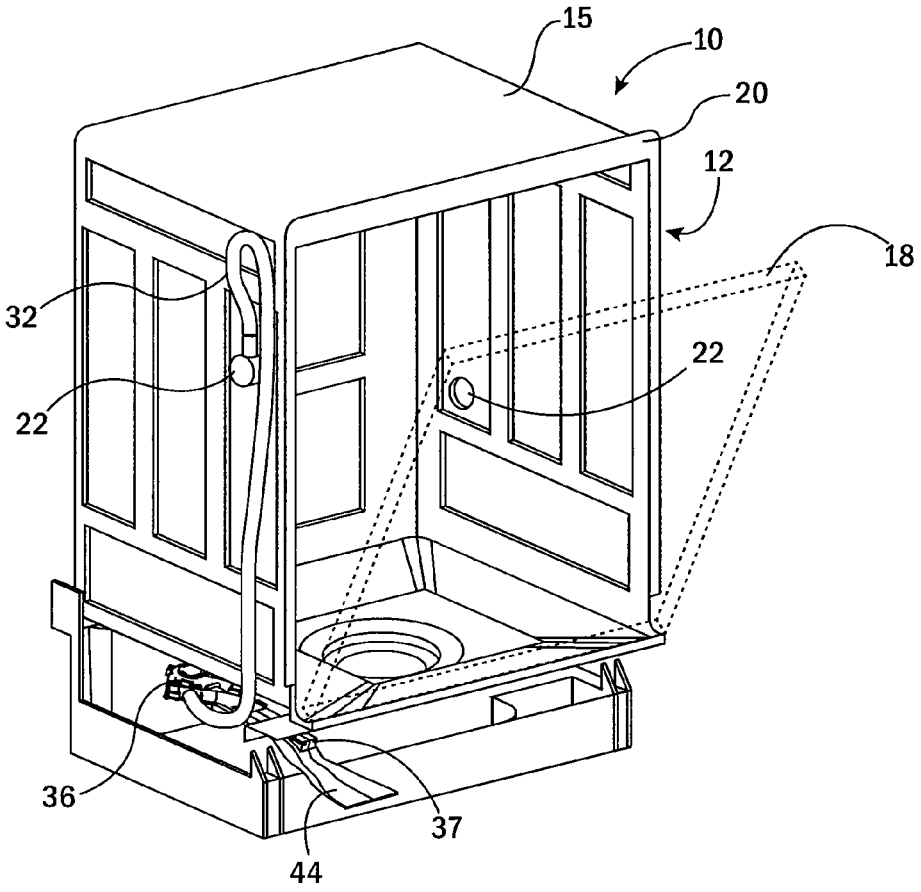
FIG. 1 is a left-side perspective view of a washing chamber housing of a dishwasher (removed from outer dishwasher structure)generally representative of a washing appliance, showing the dishwasher door in phantom and further showing the position of a first vent of the present invention on the left vertical wall of the washing chamber housing.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Figure 2:
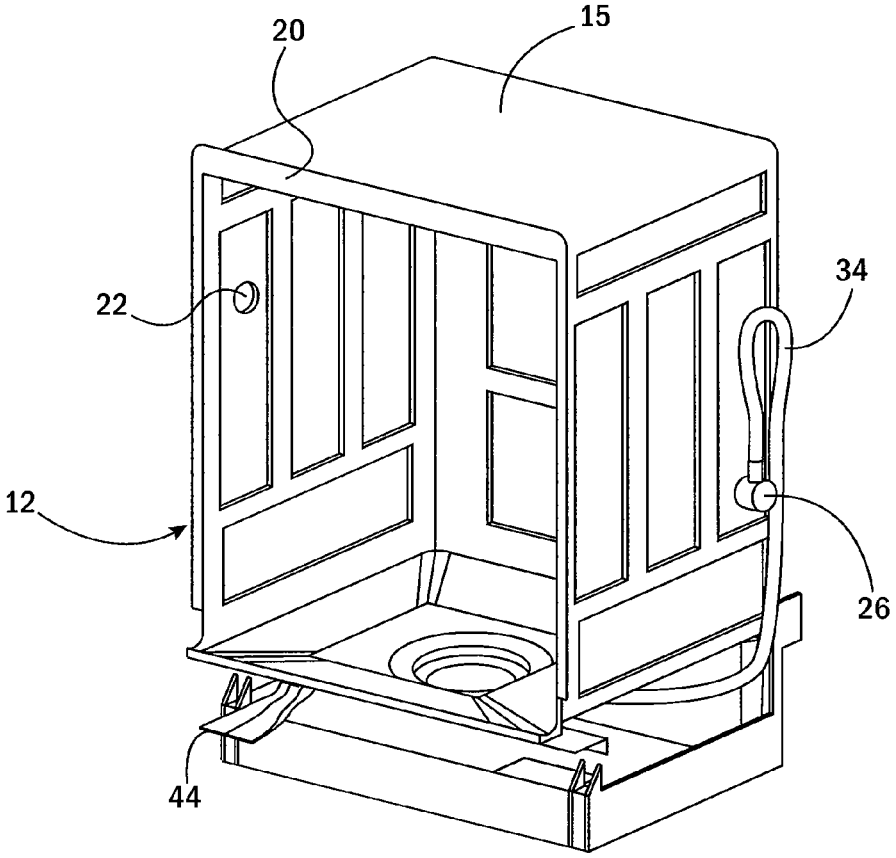
FIG. 2 is a right-side perspective view of a washing chamber housing showing the position of a second vent of the present invention on the right vertical wall of the washing chamber housing.

Referring now to FIGS. 1 and 2, a dishwasher 10 may include a washing chamber 12 into which dishes and cutlery 14 may be placed for washing on racks 16. The washing chamber 12 may be defined by a generally rectangular housing 15, for example, of drawn stainless steel or injection molded thermoplastic, providing a single piece sealable volume open at the front to be covered by a door 18 that seals against a front lip 20 of the housing 15.

A first vent 22 providing an opening through the left side wall of the housing 15 may be positioned at a level 24 above the highest rack 16 and preferably at or above the level of projecting dishes and cutlery 14.

Figure 3:
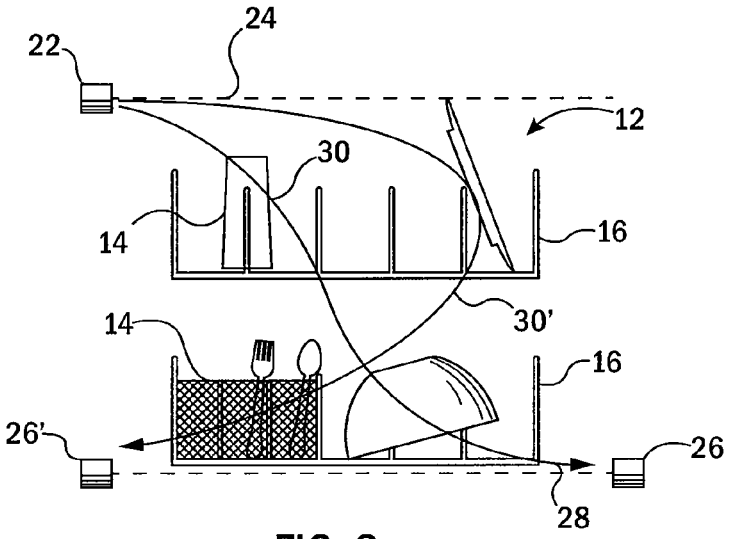
FIG. 3 is a simplified elevational front cross-sectional view of the washing chamber showing airflow between the first and second vents per FIGS. 1 and 2 and showing an alternative second vent location.

Referring now to FIGS. 2 and 3, a second vent 26 also providing an opening through the housing 15, but on a right side wall of the housing 15, may be positioned at a level 28 below the lowermost rack 16. Airflow 30 between the first vent 22 and the second vent 26 will be generally conducted in a downdraft or downward direction to flow smoothly and completely across the dishes and cutlery 14 in the racks 16. In an alternative embodiment, the second vent 26' may be placed on the left side wall of the housing 15 also at level 28 to create a functionally similar downdraft airflow 30' completely across the dishes and cutlery 14 in a slightly arcing or helical pattern.

Figure 4:
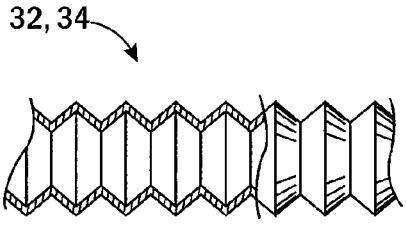
FIG. 4 is a fragmentary partial cross-section of a vent tube connected to the vents providing a corrugated surface for noise suppression and flexibility.

Referring now to FIGS. 1, 2, and 4, the vents 22 and 26 may be connected to flexible tubes 32 and 34 respectively. These tubes 32 and 34 proceed upward from the vent openings of vents 22 and 26 by a short length (3 to 6 inches) and then downward to connect with the blower assembly 36 as will be described below. These short upward sections provide a water trap causing water passing through the vent 22 or vent 26 from the volume of the housing 15, during the washing cycle of the dishwasher 10, to be trapped in the short upward length of the tubes 32 and 34 to drain back into the housing 15. This trap eliminates the need for an electrically controlled door closing the vents 22 or 26 during the washing cycle.

The tubes 32 and 34 are preferably corrugated plastic tube having a diameter of 0.6 to 1¾ or 2 inches and an axial length of several feet (and at least 12 inches). The corrugations are characterized by a bellows construction of alternating larger and smaller outside and inside diameters. This corrugation allows increased flexibility of the tubing and importantly decreases the noise transmitted through the tubing from the volume of the housing 15 during the washing cycle, in the manner of a muffler, to prevent excess noise from escaping the housing 15 during the washing cycle even in the absence of a door covering the vents 22 and 26 during the washing cycle. It is believed that the corrugations further provide for improved water condensation both in terms of the increased area, the heat conduction of the thinwall plastic material, and the turbulence provided by the corrugated surface.

Figure 5:
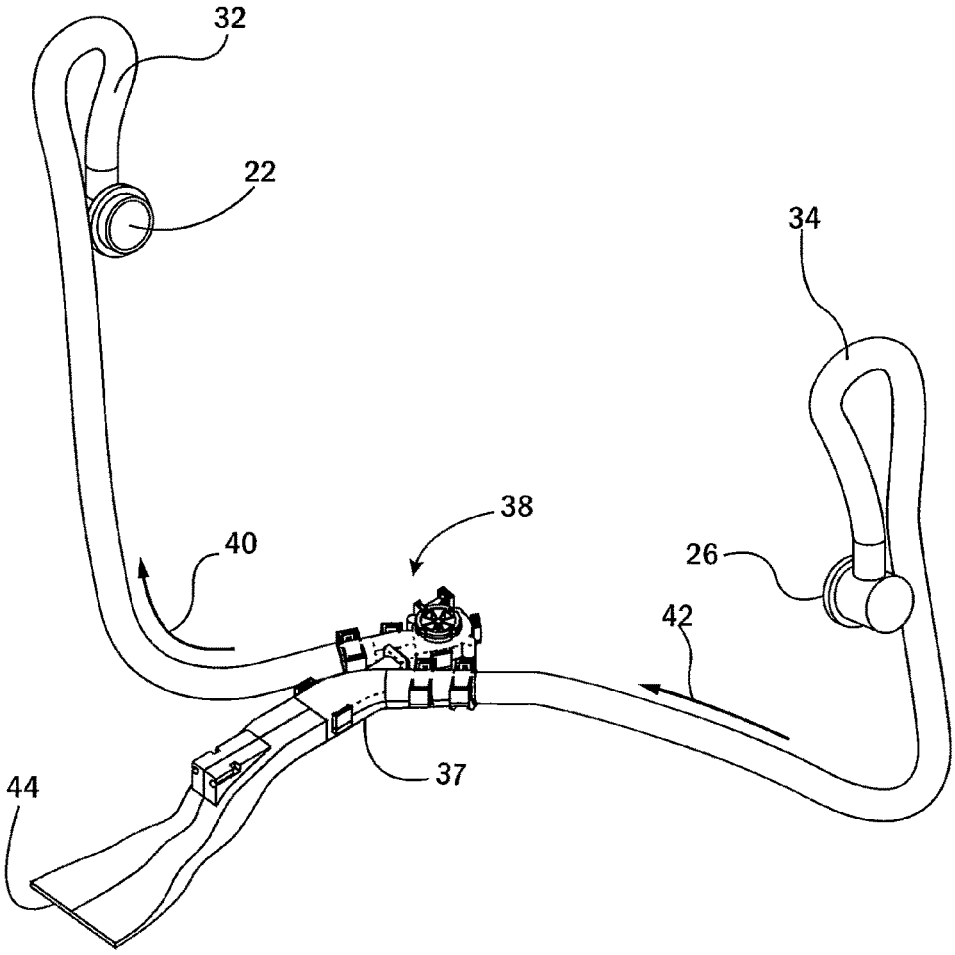
FIG. 5 is a perspective view of the vents and tubes connected to a blower assembly with the washing chamber removed for clarity.

Referring now to FIG. 5, the tubes 32 and 34 pass from respective vents 22 and 26 to the blower assembly 36 and mixing chamber 37 (as shown in FIG. 1) positioned beneath the housing 15. The blower assembly 36 includes a blower 38 configured to provide air as indicated by arrow 40 through tube 32 and out of vent 22 and to draw air as indicated by arrow 42 from vent 26 into the mixing chamber 37 to exit an exhaust slot 44 in the mixing chamber 37 positioned beneath the door 18 to the front of the housing 15 as shown in FIG. 1. The flow of air into the volume of the housing 15 from vent 22 may be substantially matched to the air drawn from the volume through vent 26 to prevent excess pressure buildup in the volume of the housing 15 such as may promote leakage of water out of the door seals.

Figure 6:
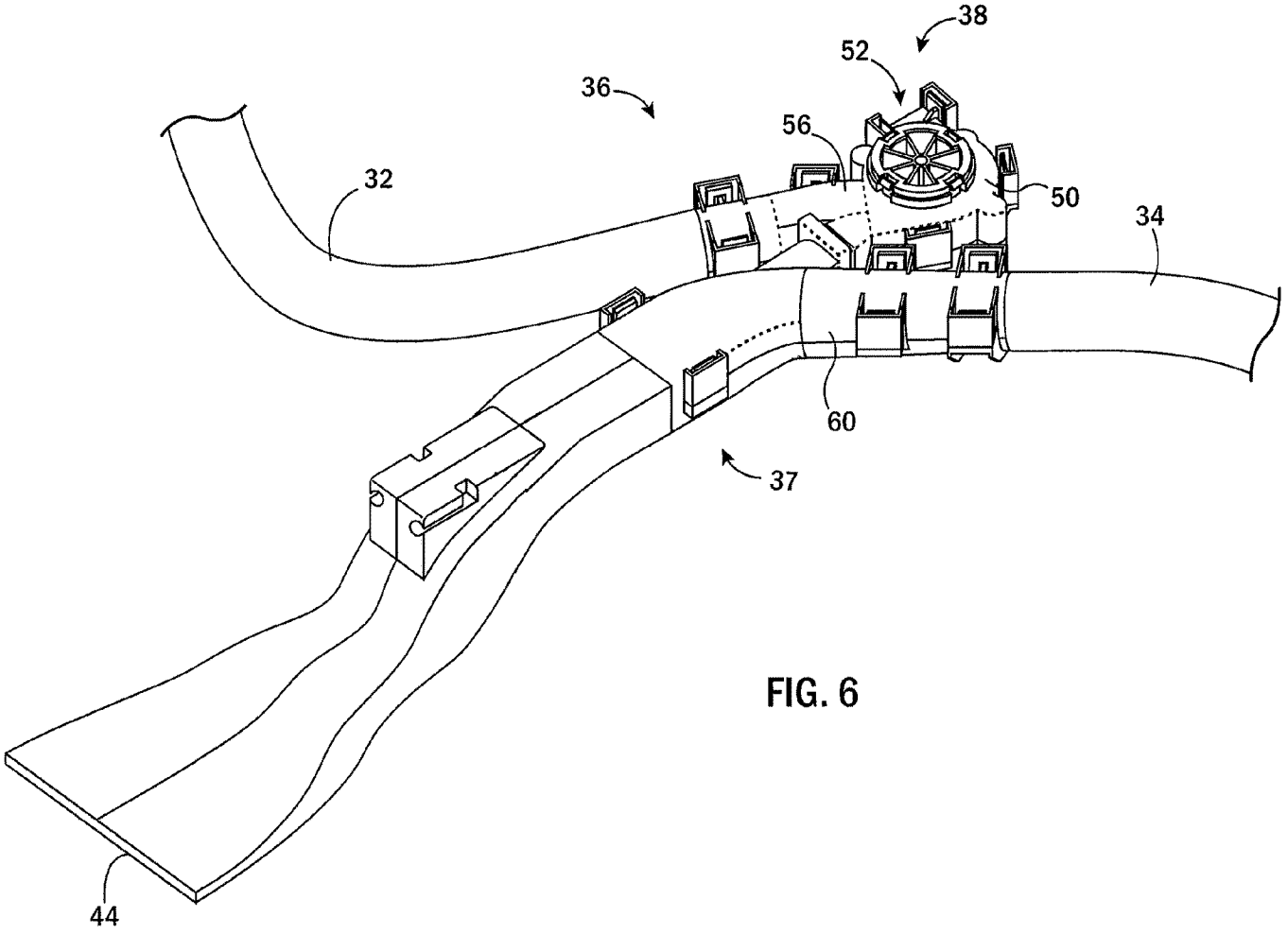
FIG. 6 is a detailed perspective view of the blower assembly showing positioning of a single upstream blower.
Figure 7:
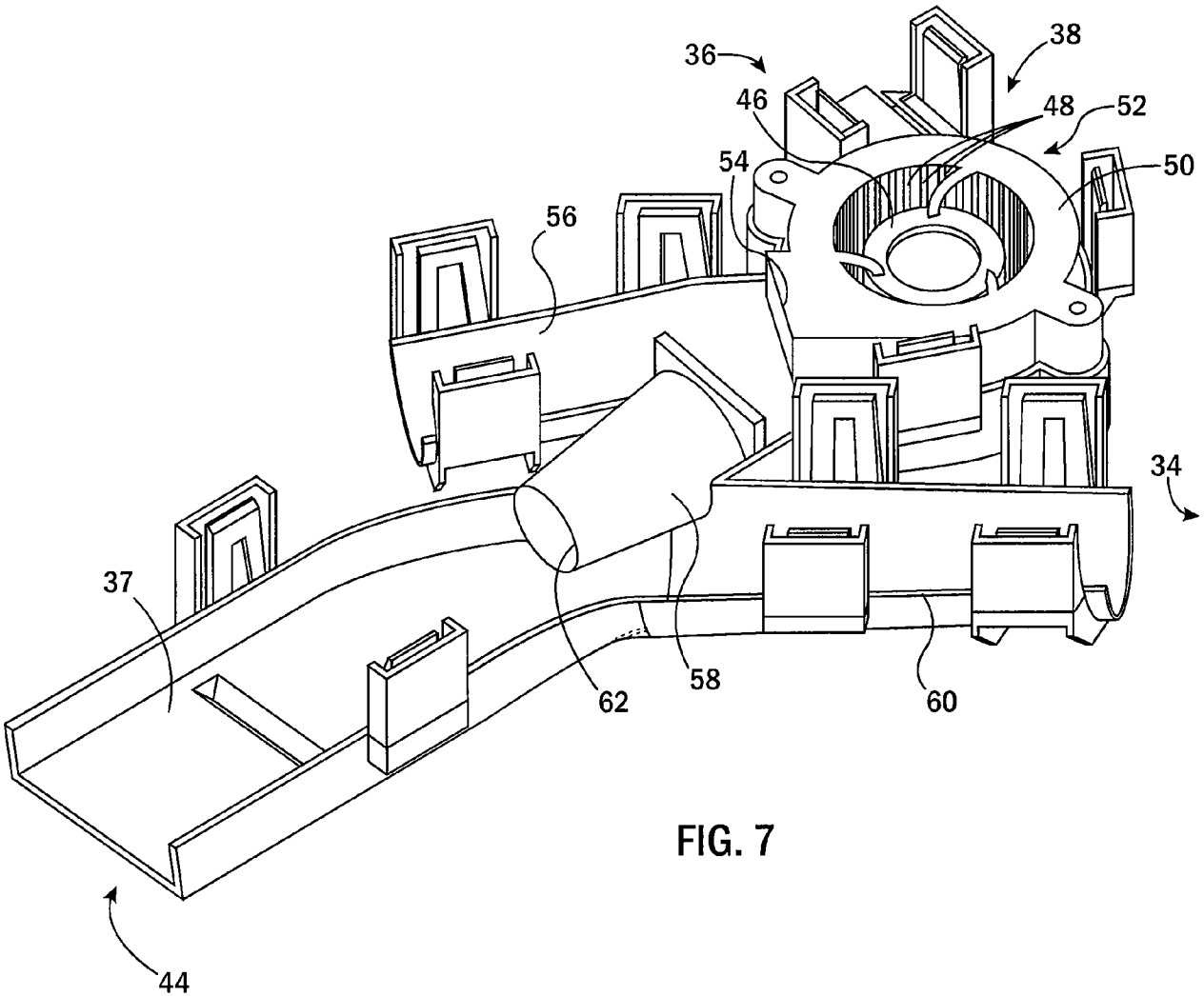
FIG. 7 is a figure similar to FIG. 6 showing the blower assembly with the top housing of the blower assembly removed to reveal a jet pump.
Figure 8:
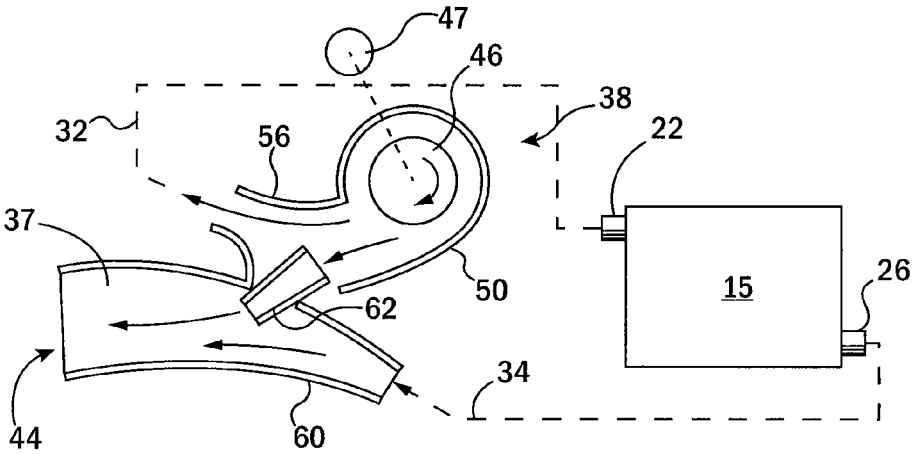
FIG. 8 is a simplified diagram of the airflow paths provided by the venting system of the present invention.

Referring now to FIGS. 6, 7 and 8, the blower 38 may provide a generally centrifugal pump having an impeller 46 rotating about a vertical axis as driven by a motor 47, the impeller 46 having radially extending vanes 48 and fitting within an involute-like housing 50. In one embodiment, the motor 47 is a brushless DC motor having a permanent magnet rotor to provide for long life and low noise operation.

Rotation of the impeller 46 draws dry and cool air into an axial inlet 52 from outside of the housing 15 and exhausts this air from an exhaust opening 54 into a bifurcated coupling dividing the exhausted air into two diverging branches. A first branch provides a relatively lower pressure airstream through a dry air conduit 56 leading to tube 32 and to the washing chamber 12.

A second branch of the air exiting the exhaust opening 54 provides a relatively higher pressure airstream diverted to pass through a nozzle 58 communicating with a moist air conduit 60 joined at one end with the tube 34 and at the other end with an exhaust slot 44 providing an outlet of the mixing chamber 37. The nozzle 58 provides an exit port 62 of high velocity air adjacent to the moist air conduit 60 and directed along an axis of the moist air conduit 60 into the mixing chamber 37 toward the exhaust slot 44. The high-pressure stream from the nozzle 58 provides a jet pump that draws air from tube 34 to exhaust through the exhaust slot 44 providing essentially a pumping action while shielding the blower 38 from contact with any moisture from the humid air.

The term "jet pump" is intended to generally include pumps that operate to cause the movement of a pumped stream of fluid as affected by motion of a pumping stream of fluid without moving mechanical elements such as may operate under the venturi principle or in the manner of an eductor-jet pump or injector pump all of which create a low pressure zone to draw a fluid from a source reservoir.

The air exiting the exit port 62 further mixes with the humid air from the tube 34 to reduce its humidity and temperature before that air exits from the exhaust slot 44.

Figure 9:
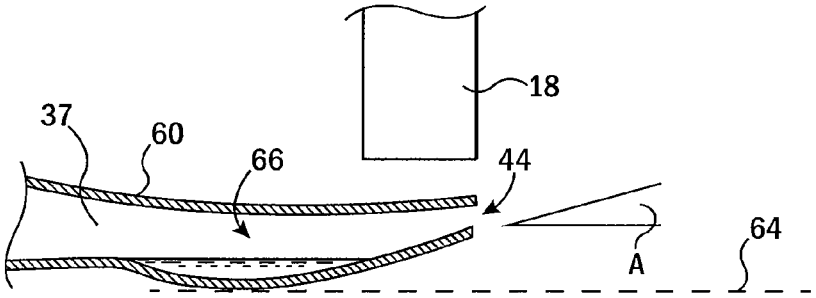
FIG. 9 is an elevational side cross-section of a discharge vent of the blower assembly showing an internal reservoir and an angle of the discharge vent to project humid air away from the floor and door.

Referring now to FIG. 9, the portion of the moist air conduit 60 near the exhaust slot 44 tips upward by an angle "A" of approximately 10 to 35 degrees with respect to a horizontal plane of the floor 64 to guide the residual humidity of the air being exhausted through exhaust slot 44 away from the floor 64 and the door 18 to reduce condensation thereon. This upward sloping of the exhaust slot 44 creates a reservoir area 66 in a bottom wall of the mixing chamber 37 which collects water precipitating in the moist air conduit 60 caused by its lowered temperature in the mixing with air from the nozzle 58 (shown in FIG. 7). This liquid in the reservoir area 66 may be dried by running the blower 38 for a period of time after the reservoir area 66 of the washing chamber 12 is fully dried so as to prevent the accumulation of water for any period of time under the control of the cycle timer (not shown).

The blower 38 may be driven by a permanent magnet DC motor or other motors of types well known in the art and provides generally a high-pressure operation that reduces fan noise by reducing the necessary rotational velocity of the fan impeller 46.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

References to an electric blower can be understood to include propeller type fans, squirrel cage type centrifugal air pumps, and the like unless otherwise noted.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties. Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

I claim:

1. A vent system for a washing appliance comprising:

a mixing chamber providing a first and second inlet separated from an outlet of the mixing chamber exhausting to the outside air, the first and second inlet configured to provide a jet pump action where a first airstream through the first inlet is introduced through a nozzle into a surrounding conduit conducting a second airstream, the first inlet cooperating with the surrounding conduit to provide an air venturi to draw the second airstream through the second inlet to mix with the first airstream and be discharged through the outlet;

a first ducting adapted to communicate between the mixing chamber and a washing chamber of the washing appliance so that the second inlet receives moist air through the first ducting from the washing chamber and the first inlet receives relatively drier air from outside of the washing chamber of the washing appliance;

a second ducting; and an electric air blower communicating with the mixing chamber to produce a pressure difference generating the first airstream;

wherein the electric air blower is positioned at the first inlet to intake the drier air from outside the air washing chamber and discharge it through the first inlet;

wherein the electric air blower communicates with the first inlet through a bifurcated passageway having a first branch attached to the first inlet and a second branch communicating with the second ducting communicating between the second branch and the washing chamber of the washing appliance to direct dry air into the washing chamber.

2. The vent system of claim 1 wherein the first ducting communicates with the washing chamber at a top of the washing chamber and the second ducting communicates with the washing chamber at a position at the bottom of the washing chamber to provide for a counter-convection airflow.

3. The vent system of claim 1 wherein the mixing chamber further includes a condensation reservoir for collecting water condensing out of the moist air.

4. The vent system of claim 3 wherein the electric air blower is displaced upward on the mixing chamber with respect to the condensation reservoir.

5. The vent system of claim 3 wherein the mixing chamber provides for a substantially horizontal airflow.

6. The vent system of claim 5 wherein the outlet of the mixing chamber is preceded by a passageway directing airflow out of the outlet at an upward angle from. horizontal during operation of the mixing chamber.

7. The vent system of claim 1 wherein only a single fan communicates with the mixing chamber.

8. The vent system of claim 1 wherein the electric air blower includes a brushless DC motor.

9. The vent system of claim 8 wherein the electric air blower is a centrifugal fan.

10. The vent system of claim 1 wherein the ducting is polymer tubing presenting inwardly extending circumferential ridges over an axial length of at least 12 inches.

11. The vent system of claim 10 wherein inwardly extending ridges are in a form of circumferential pleats in an outer wall of the tubing.

12. The vent system of claim 11 wherein the polymer tubing has an average internal diameter of between 0.6 and two inches.

13. The vent system of claim 12 wherein the tubing is formed to provide at least one upwardly extending loop in the tubing between the mixing chamber and the exhaust port.

14. The vent system of claim 1 further including a sealable chamber defining the washing chamber for receiving items to be washed therein.

15. A method of venting a washing appliance of a type having a washing chamber for receiving items to be washed therein and a mixing chamber providing a first and second inlet spaced from an outlet of the mixing chamber exhausting outside air, the first and second inlets configured to provide a jet pump action where a first airstream through the first inlet is introduced through a nozzle into a surrounding conduit conducting a second airstream, the first inlet cooperating with the surrounding conduit to provide an air venturi to draw the second airstream through the second inlet to mix with the first airstream and be discharged through the outlet and including first ducting communicating between the mixing chamber and a washing chamber of a washing appliance so that the second inlet receives moist air through the first ducting from the mixing chamber and the first inlet receives relatively drier air from outside of the washing chamber of the washing appliance and further including second ducting, and further providing an electric air blower communicating with the mixing chamber to produce a pressure difference generating the first airstream, wherein the first ducting attaches to the second inlet and the electric air blower is positioned at the first inlet to intake the drier air from outside the air washing chamber and discharge it through the first inlet; wherein the electric air blower communicates with the first inlet through a bifurcated passageway having a first branch attached to the first inlet and a second branch communicating with the second ducting communicating between the second branch and the washing chamber of the washing appliance to direct dry air into the washing chamber, the method comprising the steps of:

(a) providing a washing of dishes in the washing chamber;

(b) at the conclusion of step (a) actuating the electric air blower to move moist air out of the washing chamber into the mixing chamber and mix it with drier air before discharging the air from the outlet and to move dry air into the washing chamber.

* * * * *